US005889535A

United States Patent [19]

Jackson et al.

[11] Patent Number: 5,889,535

[45] Date of Patent: Mar. 30, 1999

[54] POSTAGE METER INCLUDING AN INKJET PRINTER WHICH HAS AN INK-JET MAINTENANCE HEAD TRANSLATING TRANSVERSE TO THE MOVEMENT OF THE INKJET PRINT HEAD

[75] Inventors: Jerome E. Jackson, Newtown; Richard A. Malin, Westport; David Priven, Stamford; Patricia Wong, Shelton, all of Conn.

[73] Assignee: Pitney Bowes Inc., Stamford, Conn.

[21] Appl. No.: 710,795

[22] Filed: Sep. 23, 1996

[51] Int. Cl.[6] ..... B41J 2/165

[52] U.S. Cl. ..... 347/22; 347/32

[58] Field of Search ..... 342/19, 37, 8, 342/22; 400/53, 719, 320, 701, 702, 702.1, 120.01; 101/DIG. 36; 347/19, 37, 38, 39, 29, 32

[56] References Cited

U.S. PATENT DOCUMENTS

| | | | |
|---|---|---|---|
| 4,937,595 | 6/1990 | Midorikawa | 347/29 |
| 5,440,331 | 8/1995 | Grange | 347/32 |
| 5,552,811 | 9/1996 | Kurata et al. | 347/28 |
| 5,610,640 | 3/1997 | Anderson et al. | 347/32 |
| 5,806,994 | 9/1998 | Coffy et al. | 347/29 |

*Primary Examiner*—N. Le
*Assistant Examiner*—Thien Tran
*Attorney, Agent, or Firm*—Angelo N. Chaclas; Lawrence E. Sklar; Melvin J. Scolnick

[57] ABSTRACT

Apparatus and a method for cleaning and maintaining an inkjet printhead with a maintenance head. The apparatus includes: an inkjet printhead translatable in a first plane; a device for translating the printhead to a cleaning station; an inkjet maintenance head translatable in a second plane, wherein the first plane is not parallel to the second plane; and a device for translating the maintenance head in at least two directions in the second plane to engage the printhead at the cleaning station.

10 Claims, 2 Drawing Sheets

POSTAGE METER INCLUDING AN INKJET PRINTER WHICH HAS AN INK-JET MAINTENANCE HEAD TRANSLATING TRANSVERSE TO THE MOVEMENT OF THE INKJET PRINT HEAD

BACKGROUND OF THE INVENTION

The instant invention relates to inkjet printheads and more particularly to a maintenance system for an ink jet printhead.

Printheads are used in many applications today, and a preferred printhead is an inkjet printer. Such printers spray small dots of ink on paper and typically move along an axis of transport. When inkjet printers are not in use they are moved to a maintenance station where a cleaning and maintenance procedure is effected which includes wiping, priming, spitting and capping. In some applications of the inkjet printer, such as in a postage meter, there is not enough room along the axis of transport to dock the printhead, and moving the printhead in a two-directional horizontal plane is excessively complex. Thus, use of an inkjet printhead in a postage meter would be difficult to effect.

Accordingly, the instant invention provides a maintenance system which does not require the inkjet printhead to move to the maintenance station and thus permits use of the inkjet printer in applications such as postage meters where it would otherwise not be feasible.

SUMMARY OF THE INVENTION

Thus, the instant invention provides apparatus and a method for cleaning and maintaining an inkjet printhead with a maintenance head. The apparatus includes: an inkjet printhead translatable in a first plane; a device for translating the printhead to a cleaning station; an inkjet maintenance head translatable in a second plane, wherein the first plane is not parallel to the second plane; and a device for translating the maintenance head in at least two directions in the second plane to engage the printhead at the cleaning station.

DETAILED DESCRIPTION OF THE PREFERRED EMBODIMENT

Figure 1:
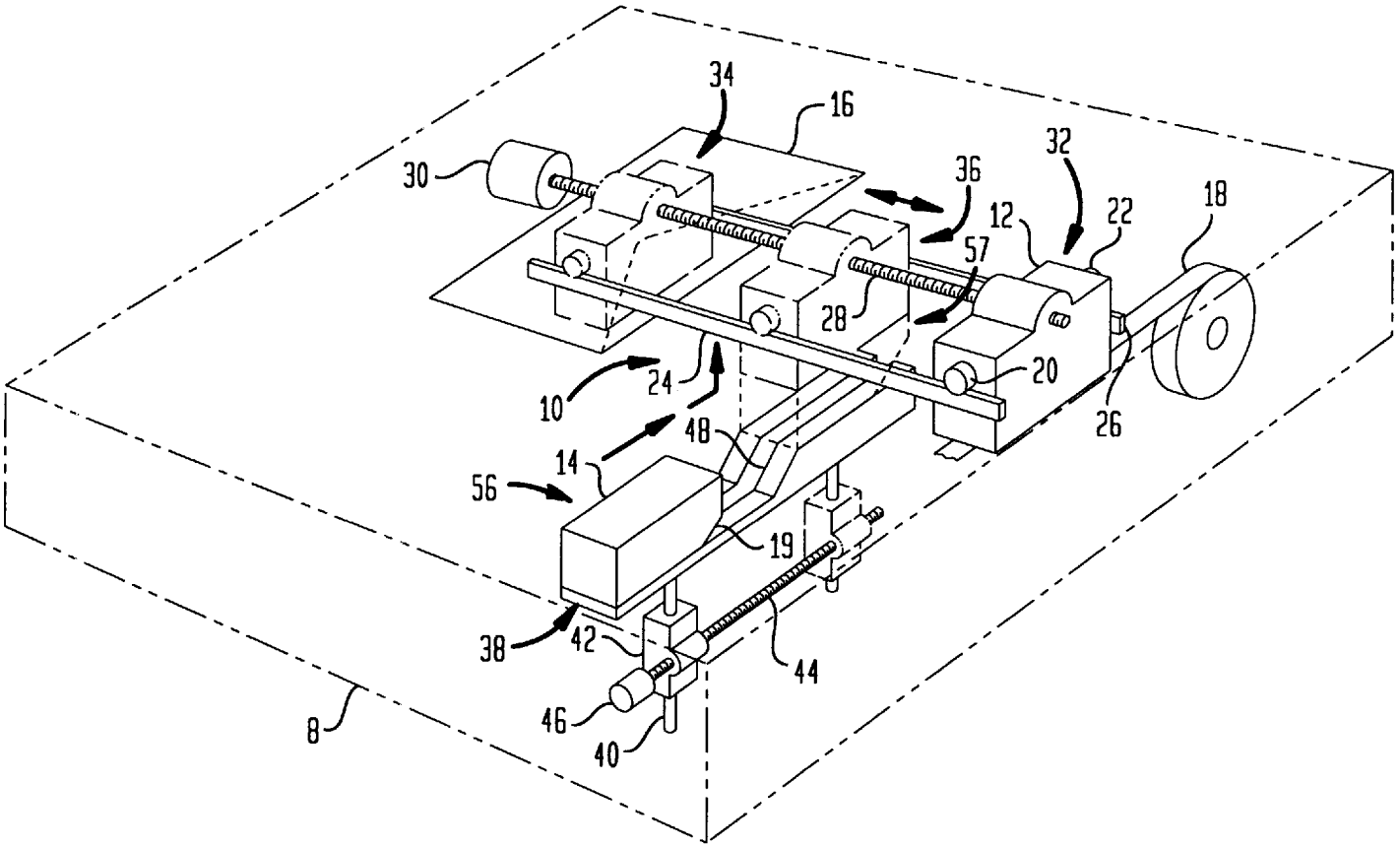
FIG. 1 a schematic, perspective view of a postage meter having an inkjet printer showing the printhead and maintenance head in accordance with the instant invention.

In describing the preferred embodiment of the instant invention, reference is made to the drawings, wherein there is seen in FIG. 1 a postage meter 8 having an inkjet printing system generally designated 10 which includes an inkjet printhead 12 and an inkjet maintenance head 14 for servicing and cleaning the printhead 12. The printhead 12 is used for printing postage indicia on an envelope 16 and also on tape 18 passing therebelow as explained in further detail hereinbelow. The printhead 12 includes a pair of rollers 20 and 22 which ride on a pair of rails 24 and 26 respectively. A lead screw 28 is driven by a drive motor 30 and threadingly engages the top of the printhead 12 in order to translate the printhead 12 back and forth along the rails 24 and 26. The printhead 12 can be stopped in one of three positions. FIG. 1 shows the printhead 12 stopped at station 1 indicated by arrow 32, at which station 1 the printhead 12 can print on the tape 18 in conventional manner. The printhead 12 can also be stopped at station 2 indicated by the arrow 34 at which station 2 the printhead 12 can print on the envelope 16 in conventional manner. The home or resting position of the printhead 12 is at station 3 indicated by the arrow 36.

Figure 2:
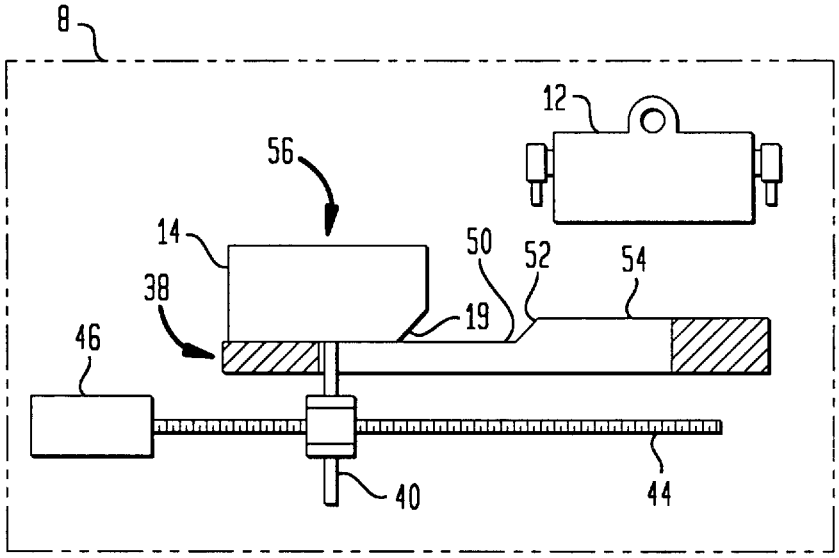
FIG. 2 is a schematic, side, elevational view of the maintenance head in its home position.
Figure 3:
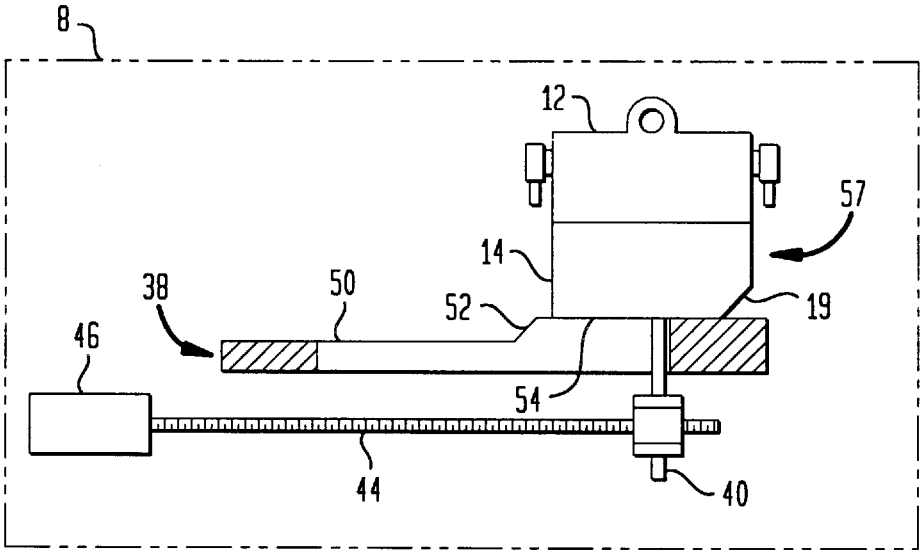
FIG. 3 is similar to FIG. 2 but shows the maintenance head in the capping position adjacent the printhead.

The maintenance head has a camming surface 19 and 14 sits on a track 38 and is translatable along the track 38 by means of a pin 40 which engages an aperture (not shown) in the maintenance head 14 The track 38 is vertically aligned with the printhead station 3. The pin 40 is seated in a block 42 which threadingly engages a lead screw 44 which in turn is driven by a drive motor 46. The track 38 includes a slot 48 in which the pin 40 is translated. As best seen in FIGS. 2 and 3, the track 38 includes a horizontal path or section 50, an angled, cam section 52, and a second, horizontal section 54 at the end thereof. The cam section 52 is shown angled at a diagonal, but other angles could be employed. In FIGS. 1 and 2, the maintenance head 14 is shown at its home or resting position which is station 4 indicated by the arrow 56. The maintenance head 14 is situated at station 4 whenever the printhead 12 is being used to print the envelopes 16 or the tape 18.

Whenever the printhead 12 is not being used to print envelopes 16 or tape 18, the printhead 12 is translated by the lead screw 28 to the position of station 3 and remains stationary at station 3. Whenever the printhead 12 is stationary at station 3, the inkjet printing system 10 is programmed to move the maintenance head 14 to station 5 indicated by the arrow 57 into a cleaning position which is a docking relationship with the printhead 12, as shown in FIG. 3, i.e. the maintenance head 14 is moved below the printhead 12.

The movement of the maintenance head 14 along the track 38 to the station 5 will now be described. The maintenance head 14 moves in a single, vertical plane which is aligned with the printhead home station 3. The initial movement of the maintenance head 14 along the track 38 is from left to right on the first horizontal path 50. Continued translation of the pin 40 by the drive motor 46 causes the maintenance head 14 to approach the cam section 52, at which point the camming surface 19 of the maintenance head 14 engages the cam section 52 to thereby lift the maintenance head 14 as it is being translated from left to right. When the camming surface 19 has finished traversing the cam section 52, the maintenance head 14 is elevated and moves again from left to right along the second horizontal track section 54 to the cleaning position seen in FIG. 3. Thus, the maintenance head 14 experiences lateral and vertical movement in being moved from its home position at station 4 to its cleaning position at station 5 where the top surface of the maintenance head 14 engages the bottom surface of the printhead 12. The lateral movement takes place along the horizontal track sections 50 and 54, and both lateral and vertical movement takes place along the cam section 52. The movement along the horizontal track sections 50 and 54 comprises movement in one direction and the movement along the cam section 52 comprises movement in a second direction. Thus, there is movement by the maintenance head 14 in two directions. Clearly, the two directions of movement will comprise elements of both lateral and vertical movement. Since both lateral and vertical movement of the maintenance head 14 is required to move it into its cleaning position at station 5, movements other than what is shown in FIGS. 1–3 could be employed, e.g.

one direction of movement could be purely horizontal and another direction of movement could be purely vertical.

When the maintenance head 14 moves past the printhead 12 located thereabove, the wiper (not shown) of the maintenance head 14 wipes the nozzles (not shown) on the bottom of the printhead 12 in conventional manner. The capping device (not shown) of the maintenance head 14 hermetically seals the nozzles of the printhead 12 when the maintenance head 14 is stopped from further translation along the track 38, and a vacuum can be applied from the maintenance head 14 to remove ink from the nozzles. Additionally, the nozzles of the printhead 12 can be fired into the spittoon of the maintenance head.

The inkjet printing system 10 described hereinabove is arranged in such a way that it occupies a minimum of space and thus can be used in many applications which otherwise lack sufficient space for an inkjet printer. A postage meter is just one example of the many applications for which the foregoing inkjet printing system 10 is suitable.

While the present invention has been disclosed and described with reference to a single embodiment thereof, it will be apparent, as noted above that variations and modifications may be made therein. It is, thus, intended in the following claims to cover each variation and modification that falls within the true spirit and scope of the present invention.

What is claimed is:

1. A postage meter including an inkjet printer, the postage meter comprising:

means for feeding an envelope in a first direction; and the inkjet printer including:

an inkjet print head slideably mounted to the inkjet printer;

means operatively coupled to the inkjet print head for translating the inkjet print head back and forth along a single second direction perpendicular to the first direction between a print station where the inkjet print head is disposed adjacent to the envelope and a cleaning station;

an inkjet maintenance head slideably mounted to the inkjet printer; and means operatively coupled to the inkjet maintenance head for translating the inkjet maintenance head back and forth in at least a third direction and a fourth direction defining a plane, the plane being perpendicular to the single second direction and parallel to the first direction so that the inkjet maintenance head engages the inkjet print head at the cleaning station.

2. The postage meter of claim 1, wherein:

the inkjet print head is translated to the cleaning station before the maintenance station is translated to the cleaning station to effect a maintenance operation.

3. The postage meter of claim 2, wherein:

the first direction is horizontal.

4. The postage meter of claim 3, wherein:

the plane is vertical.

5. The postage meter of claim 4, wherein:

the inkjet print head includes a bottom surface and the inkjet maintenance head includes a top surface, and the inkjet maintenance head top surface engages the inkjet print head bottom surface when the inkjet print head and the inkjet maintenance head are at the cleaning station.

6. A method of operating a postage meter including an inkjet printer, the method comprising the step(s) of:

feeding an envelope in a first direction;

translating an inkjet print head back and forth in a single second direction perpendicular to the first direction;

translating the inkjet print head along the single second direction between a print station where the inkjet print head is disposed adjacent to the envelope and a cleaning station;

translating an inkjet maintenance head back and forth in at least a third direction and a fourth direction defining a plane, the plane being perpendicular to the single second direction and parallel to the first direction; and translating the inkjet maintenance head in the third direction and the fourth direction within the plane to engage the inkjet print head at the cleaning station.

7. The method of claim 6, further comprising the step(s) of:

translating the inkjet print head to the cleaning station and then translating the maintenance station to the cleaning station to effect a maintenance operation.

8. The method of claim 7, further comprising the step(s) of:

defining the first direction as horizontal.

9. The method of claim 8, further comprising the step(s) of:

defining the plane as vertical.

10. The method of claim 9, further comprising the step(s) of:

providing the inkjet print head with a bottom surface and the inkjet maintenance head with a top surface wherein the inkjet maintenance head top surface engages the inkjet print head bottom surface when the inkjet print head and the inkjet maintenance head are at the cleaning station.

* * * * *